US011330364B1

(12) United States Patent
Delay et al.

(10) Patent No.: US 11,330,364 B1
(45) Date of Patent: May 10, 2022

(54) PORTED SPEAKER ASSEMBLY

(71) Applicant: Robert Bosch GmbH, Stuttgart (DE)

(72) Inventors: Mark Delay, Saint Paul, MN (US); Andrew Pardoe, Eden Prairie, MN (US); Nolen Ryba, Minnetonka, MN (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/147,236

(22) Filed: Jan. 12, 2021

(51) Int. Cl.

| | |
|---|---|
| ***H04R 9/06*** | (2006.01) |
| ***H04R 1/28*** | (2006.01) |
| ***H04R 1/02*** | (2006.01) |
| ***H04R 1/24*** | (2006.01) |
| ***H04R 1/30*** | (2006.01) |
| *H04R 1/20* | (2006.01) |

(52) U.S. Cl.
CPC ..... *H04R 1/2826* (2013.01); *H04R 1/025* (2013.01); *H04R 1/24* (2013.01); *H04R 1/2888* (2013.01); *H04R 1/30* (2013.01); *H04R 2400/11* (2013.01)

(58) Field of Classification Search
CPC ..... H04R 1/2826; H04R 1/025; H04R 1/24; H04R 1/2888; H04R 1/30; H04R 2400/11
USPC ..... 381/335
See application file for complete search history.

(56) References Cited

U.S. PATENT DOCUMENTS

| | | | | |
|---|---|---|---|---|
| 2,167,625 | A | 8/1939 | Albano | |
| 2,852,087 | A | 9/1958 | Ruschhaupt | |
| 3,169,601 | A | 2/1965 | Smith | |
| 3,342,498 | A | 9/1967 | Eberhardt | |
| 4,220,220 | A * | 9/1980 | Ripple | H04R 1/2834 181/148 |
| 4,298,087 | A | 11/1981 | Launay | |
| 4,440,260 | A | 4/1984 | Jacobsen | |
| 5,189,706 | A | 2/1993 | Saeki | |
| 6,062,339 | A | 5/2000 | Hathaway | |
| 6,144,751 | A | 11/2000 | Velandia | |

(Continued)

OTHER PUBLICATIONS

Half Price Car Audio, "Car Audio Dual 12 Slot Ported Stereo Labyrinth Sub Box Speaker Subwoofer 3/4 Mdf & Sub Wire Kit", <https://www.halfpricecaraudio.com/Car-Audio-Dual-12-Slot-Ported-Stereo-Labyrinth-Sub-Box-Speaker-Subwoofer-3-4-Mdf-Sub-Wire-Kit-2X12VMBASS-WKIT.htm>, webpage publicly available at least as early as Jun. 2020.

(Continued)

*Primary Examiner* — Ammar T Hamid
(74) *Attorney, Agent, or Firm* — Michael Best & Friedrich LLP

(57) ABSTRACT

A ported speaker assembly includes an outer enclosure having a front opening. An inner frame of the speaker assembly is positioned at least partially within the outer enclosure and has an outer perimeter edge proximate the front opening of the outer enclosure. A resonator chamber is defined between an interior of the outer enclosure and an exterior of the inner frame. At least one speaker driver is mounted to the inner frame and configured to emit sound from a front end of the ported speaker assembly. A perimeter port is formed between the outer perimeter portion of the inner frame and the front opening of the outer enclosure. The perimeter port extends uninterrupted to encircle the outer perimeter portion. A plurality of fastener joints secure the inner frame to the outer enclosure, and at least some are distributed around multiple sides of the inner frame and positioned closer to the front opening of the outer enclosure than a rear end of the inner frame.

19 Claims, 6 Drawing Sheets

(56) References Cited

U.S. PATENT DOCUMENTS

| | | | | |
|---|---|---|---|---|
| 6,339,649 | B1 | 1/2002 | Chen et al. | |
| 7,162,048 | B2 * | 1/2007 | Shima | H04R 1/025 381/334 |
| 7,450,733 | B2 | 11/2008 | Suprapmo et al. | |
| 8,406,444 | B2 | 3/2013 | Wang | |
| 2007/0261911 | A1 * | 11/2007 | Nichols | H04R 1/2826 181/150 |
| 2009/0211840 | A1 * | 8/2009 | Jiang | H04R 1/02 181/199 |

OTHER PUBLICATIONS

JBL Pro, "PD700i Series Precision Directivity Dual-Trap", <https://jblpro.com/en/product_families/pd700i-series-precision-directivity-dual-trap>, webpage publicly available at least as early as Apr. 2020, 3 pages.

Fulcrum Acoustic, "AH4—Higher-Output—Coaxial Horn", <https://www.fulcrum-acoustic.com/product/ah4-higher-output-coaxial-horn/>, webpage publicly available at least as early as Apr. 2020, 4 pages.

Danley Sound Labs, "Synergy Horn", <https://www.danleysoundlabs.com/products/loud-speakers/synergy-horn/>, webpage publicly available at least as early as Apr. 2020, 4 pages.

Danley Sound Labs, "Jericho Series", <https://www.danleysoundlabs.com/jericho-series/>, webpage publicly available at least as early as Apr. 2020, 4 pages.

* cited by examiner

PORTED SPEAKER ASSEMBLY

BACKGROUND

The present invention relates to the manufacture of speaker assemblies for audio reproduction. Cabinets or enclosures for large speaker assemblies, and in particular loudspeakers that contain two, three, or more drivers including one or more large low frequency drivers, can impart substantial requirements for part tolerancing, across numerous fastening locations, and/or relative difficulty in mating the large subassemblies that make up the speaker assembly. A speaker assembly that incorporates a tuned-frequency resonator chamber further adds design complexity to the overall assembly, and typically forces an overall larger envelope than otherwise required for the size of the driver(s) provided.

SUMMARY

In one aspect, the invention provides a ported speaker assembly including an outer enclosure having a front opening. An inner frame of the speaker assembly is positioned at least partially within the outer enclosure and has an outer perimeter portion proximate the front opening of the outer enclosure. A resonator chamber is defined between an interior of the outer enclosure and an exterior of the inner frame. At least one speaker driver is mounted to the inner frame and configured to emit sound from a front end of the ported speaker assembly. A perimeter port is formed between the outer perimeter portion of the inner frame and the front opening of the outer enclosure to establish sound wave communication between the resonator chamber and a surrounding external atmosphere for tuned-frequency resonance output. The perimeter port extends uninterrupted about the outer perimeter edge of the inner frame so as to encircle the outer perimeter edge. A plurality of fastener joints secure the inner frame to the outer enclosure, and at least some of the plurality of fastener joints are distributed around multiple sides of the inner frame and positioned closer to the front opening of the outer enclosure than a rear end of the inner frame.

In another aspect, the invention provides a ported speaker assembly including an outer enclosure having a front opening defined between a top side, a bottom side, and two lateral sides, the outer enclosure defining an internal resonator chamber. An inner frame is positioned at least partially within the outer enclosure and having an outer perimeter portion proximate the front opening of the outer enclosure. A resonator chamber is defined between an interior of the outer enclosure and an exterior of the inner frame. At least one speaker driver is mounted to the inner frame and configured to emit sound from a front end of the ported speaker assembly. A perimeter port is formed between the outer perimeter portion of the inner frame and the front opening of the outer enclosure to establish sound wave communication between the resonator chamber and a surrounding external atmosphere for tuned-frequency resonance output. A plurality of fastener joints secure the inner frame to the outer enclosure, each of the plurality of fastener joints including a threaded fastener, a clearance hole for receiving the threaded fastener, and a nut portion for engaging the threaded fastener. The clearance hole of each of the plurality of fastener joints provides a clearance at least 25 percent over standard normal clearance for the size of the threaded fastener.

In yet another aspect, the invention provides a method of assembling a speaker assembly. An outer enclosure is provided having a front opening, and an inner frame is provided having an outer perimeter portion with a shape that corresponds to that of the front opening and a size that is smaller than that of the front opening. At least one speaker driver is assembled to the inner frame with the inner frame removed from the outer enclosure. The inner frame with the at least one mounted speaker driver is inserted into the outer enclosure through the front opening thereof to form a perimeter port between the outer perimeter portion of the inner frame and the front opening of the outer enclosure and to define a resonator chamber between an interior of the outer enclosure and an exterior of the inner frame. All assembly tolerance between the inner frame and the outer enclosure is absorbed through a plurality of fastener joints that are secured between the inner frame and the outer enclosure.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Figure 1:
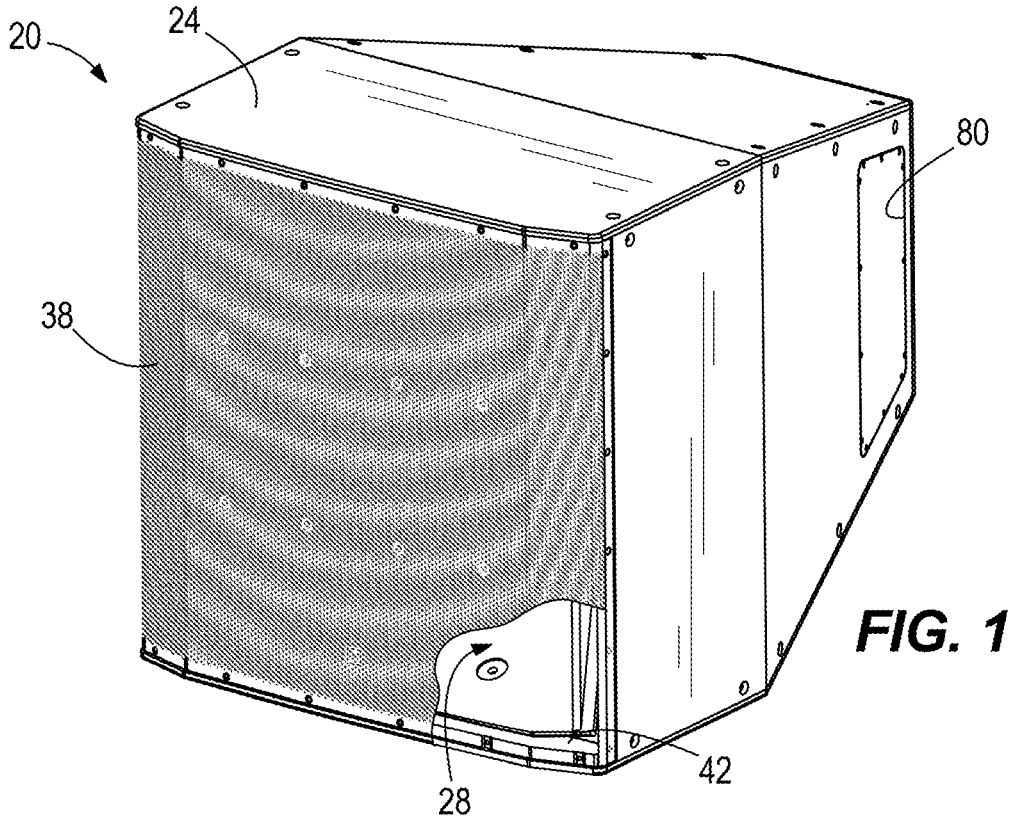
FIG. 1 is a front perspective view of a perimeter ported speaker assembly according to one embodiment of the invention. A frontal grille is rendered transparent to illustrate internal detail.
Figure 2:
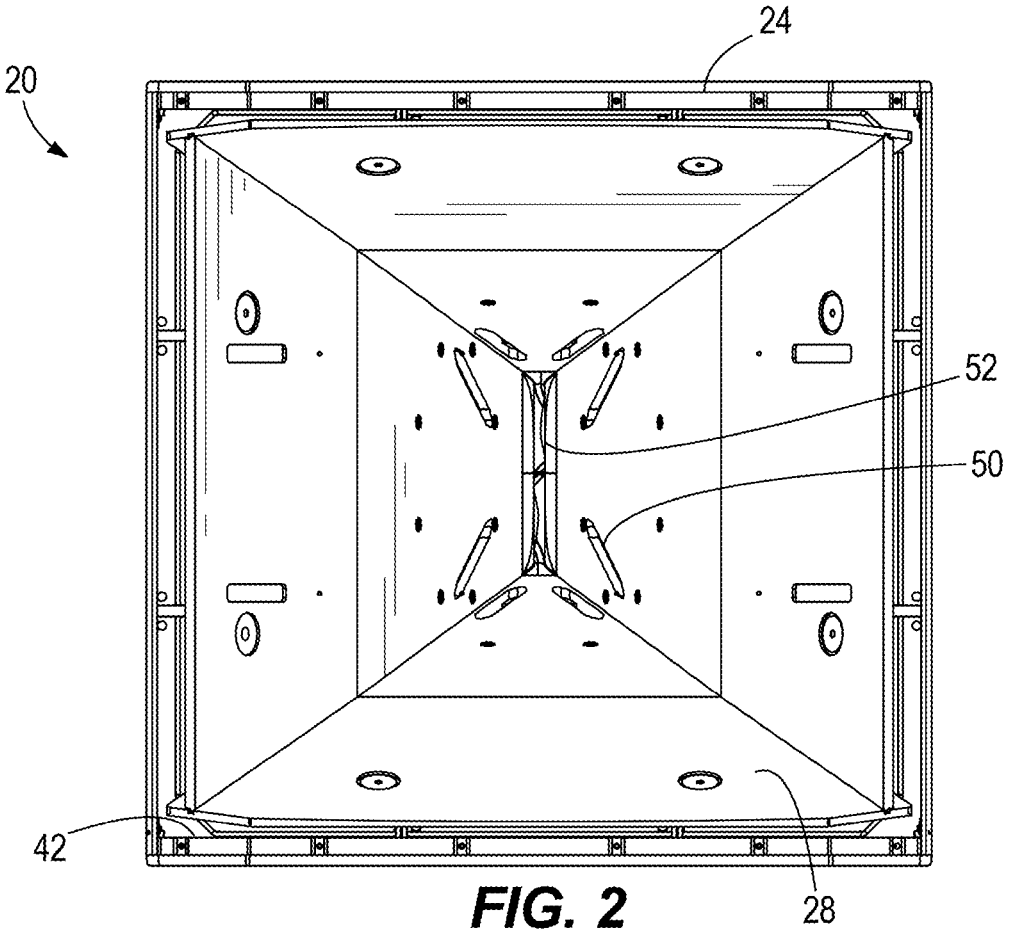
FIG. 2 is a front view of the speaker assembly of FIG. 1.
Figure 6:
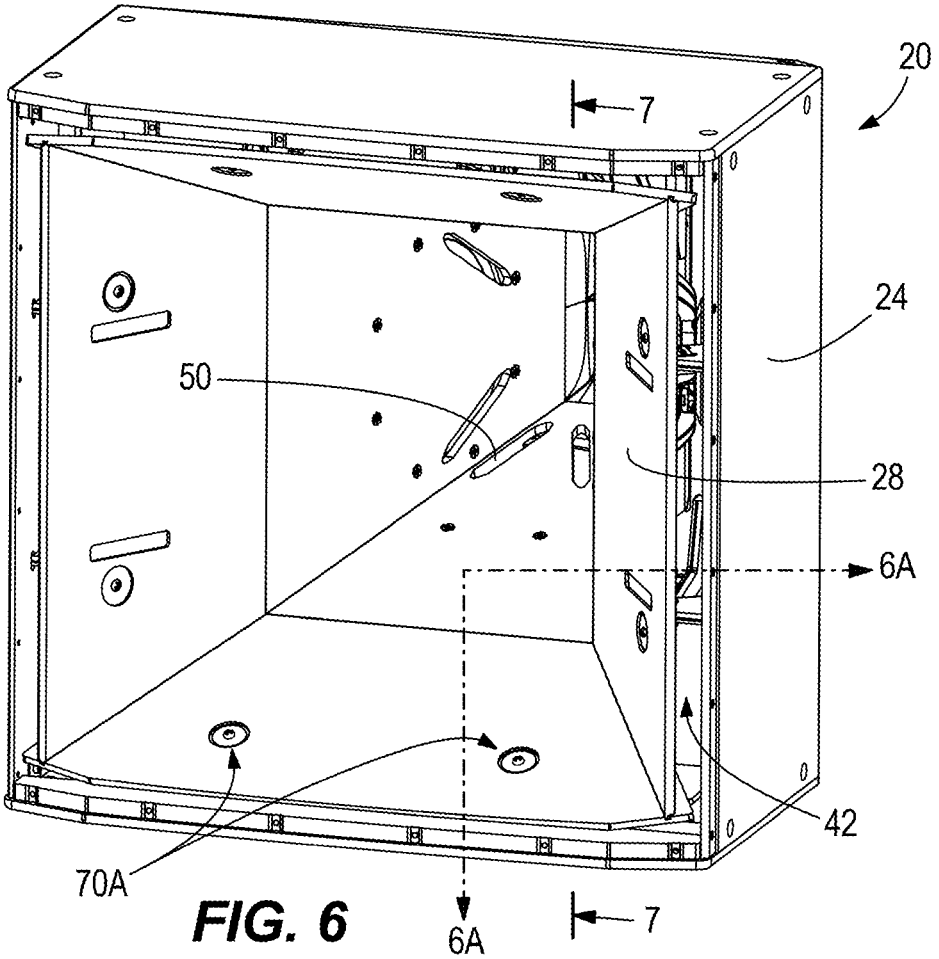
FIG. 6 is a front perspective view illustrating one exemplary fastener joint between the outer enclosure and the inner frame in exploded assembly.
Figure 6A:
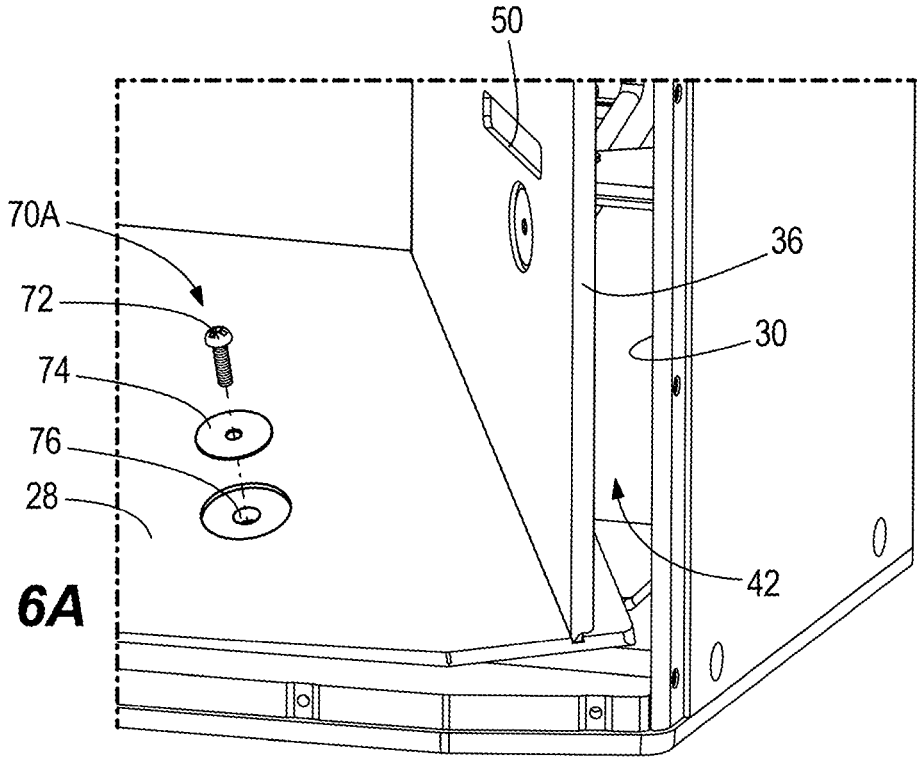
FIG. 6A is a detail view of a lower right hand side of the speaker assembly as shown in FIG. 6.

A ported speaker assembly 20 is illustrated in FIGS. 1-8A. The illustrated speaker assembly 20 is a multi-driver horn-loaded loudspeaker, although alternate configurations are optional while retaining other aspects of the present disclosure. As shown in FIGS. 1-5, the speaker assembly 20 includes an outer shell or enclosure 24 and an inner frame 28 positioned at least partially within the outer enclosure 24. In some constructions, one or both of the outer enclosure 24 and the inner frame 28 are constructed of wood (e.g., solid wood, manufactured wood, or particle board), and may be constructed of a plurality of wood pieces glued and/or fastened together. The inner frame 28 of the illustrated construction forms an acoustic horn. As shown in FIG. 6, the outer enclosure 24 defines a front opening 30 leading to an internal resonator chamber 34 that cooperates with a port 42 to form a tuned-frequency resonator system (or so-called "bass reflex" system). As will be appreciated by those of skill in the art, the tuned-frequency resonator system is an acoustic example theoretically following the model of a mechanical spring-mass system in which the resonator chamber 34 has a prescribed air volume that correlates to spring stiffness, while the mass is represented by the configuration of the port 42, in particular decreasing with increasing cross-section area and increasing with increasing length. The inner frame 28 has an outer perimeter portion proximate the front opening 30 of the outer enclosure 24. For example, a front edge 36 of the inner frame 28 may constitute the outer perimeter portion, positioned directly within the front opening 30 of the outer enclosure 24. However, alternate constructions are envisioned, particularly where the front edge 36 extends out forward of the front opening 30 or is recessed therefrom. The shape of the perimeter portion of the inner frame 28 corresponds to that of the front opening 30, although it is smaller. As described in further detail below, the port 42 is a perimeter port 42 formed between the outer perimeter portion (e.g., front edge 36 as shown) of the inner frame 28 and the front opening 30 of the outer enclosure 24. The perimeter port 42 provides sound wave communication between the internal resonator chamber 34 and the surrounding external atmosphere. The perimeter port 42 extends uninterrupted about the outer perimeter of the inner frame 28 so as to encircle it. The perimeter port 42 has a rectangular shape in front view, owing to the rectangular cross-sections of both the front opening 30 and the outer perimeter portion of the inner frame 28. A front grille 38 (FIG. 1, shown with partial breakaway) constructed of mesh, screen, fabric, perforated sheeting or another suitable material is positioned at the front end of the speaker assembly 20 and may be secured at the front opening 30.

Figure 3:
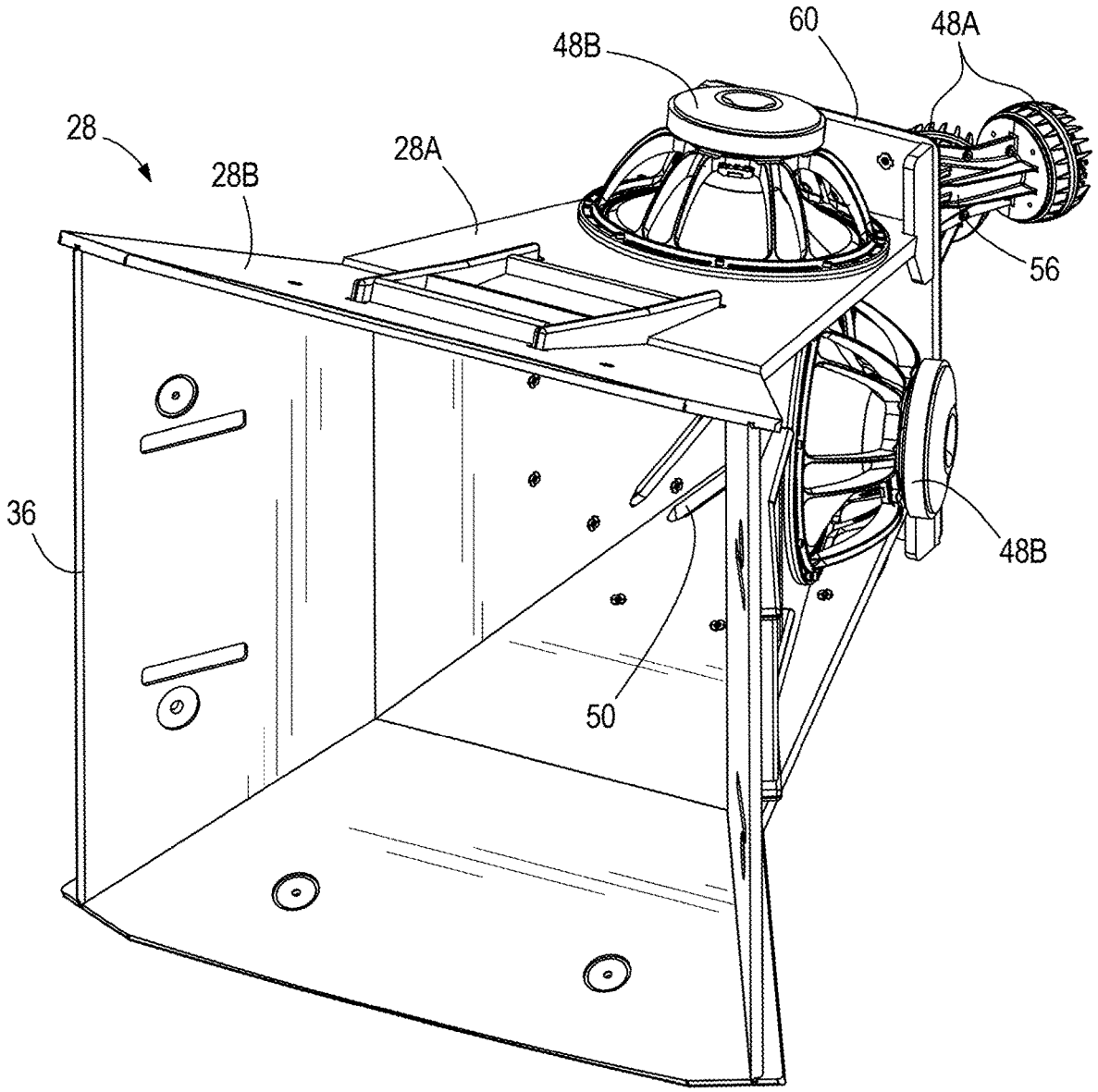
FIG. 3 is a front perspective view of an inner frame of the speaker assembly, which acts as an acoustic horn supporting a plurality of high and low frequency speaker drivers.
Figure 4:
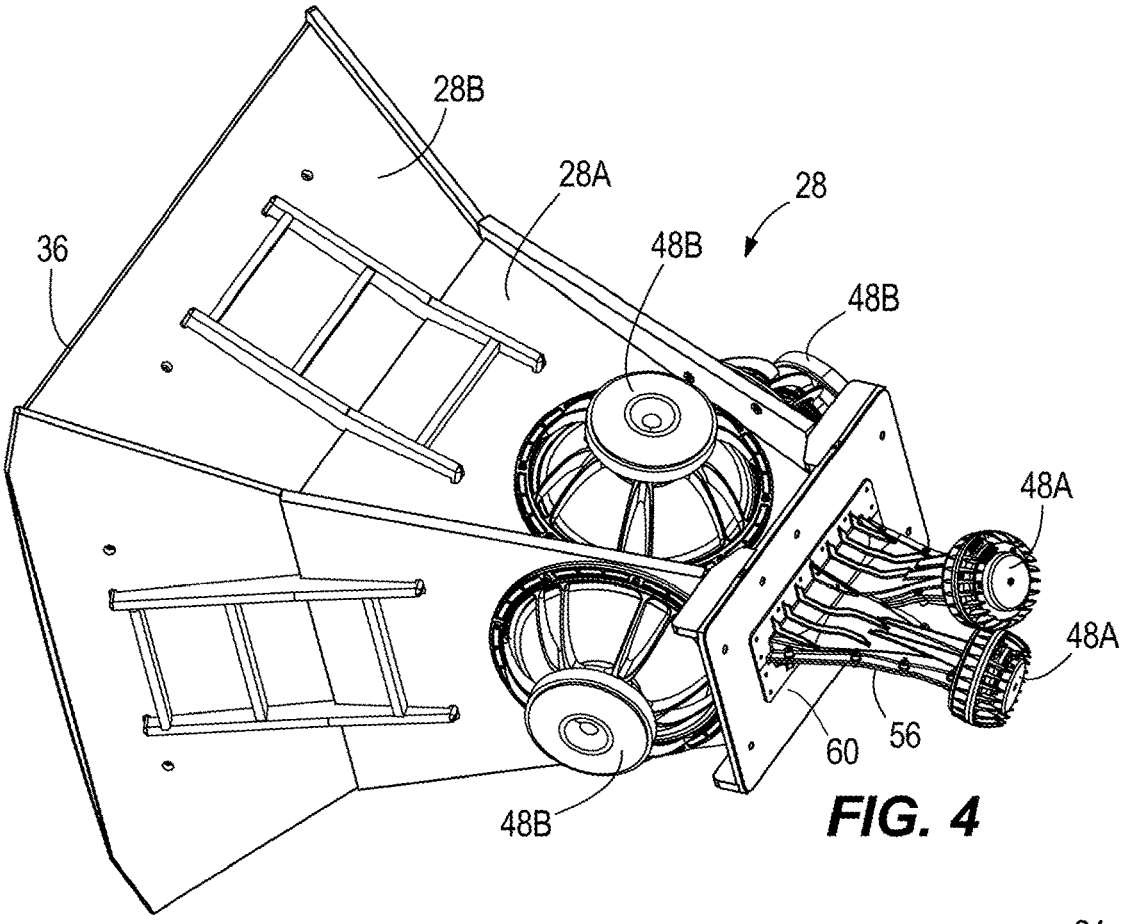
FIG. 4 is a rear perspective view of the inner frame.
Figure 5:
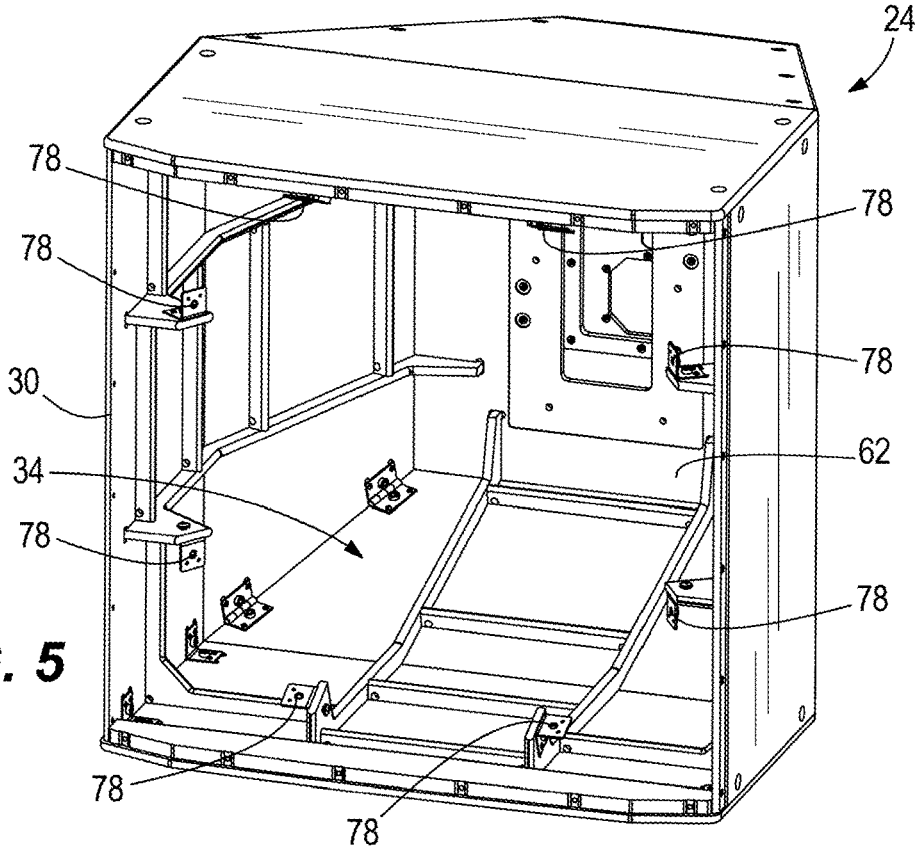
FIG. 5 is a front perspective view of an outer enclosure of the speaker assembly in which the inner frame is at least partially received.

The speaker assembly 20 includes at least one speaker driver 48A, 48B mounted to the inner frame 28 and configured to emit sound from the front end of the speaker assembly 20. The speaker assembly 20, and particularly the inner frame 28, can define a central axis for sound projection that is directly out of the page as viewed in the front view of FIG. 2. The illustrated inner frame 28 forms an acoustic horn for precisely controlling the directivity of a wide frequency range of sound. The inner frame 28 can thus include a primary flare or cone portion 28A and a secondary flare or cone portion 28B further forward and extending to the front edge 36. A plurality of speaker drivers 48A, 48B supported by the illustrated inner frame 28 includes drivers (i.e., electrodynamic audio transducers) of different types, varying by frequency output. For example, the speaker assembly 20 includes a plurality (e.g., two) of high frequency drivers 48A and a plurality (e.g., four) of low frequency drivers 48B. As can be seen in FIGS. 3 and 4, the low frequency drivers 48B can be distributed around multiple sides of the inner frame 28, for example on all four sides about the central axis. Openings 50 through the inner frame 28 are provided at the locations of the low frequency drivers 48B so as to enable sound transmission from an outside of the inner frame 28 (within the resonator chamber 34) to an inside of the inner frame 28. The low frequency drivers 48B are positioned farther forward than the high frequency drivers 48A, which are coupled to the rear end or rear panel 60 of the inner frame 28. Although not required in all embodiments, the rear of inner frame 28 includes an elongate slot opening 52 (FIG. 2) forming a horn inlet to which the high frequency drivers 48A are coupled through a wave guide 56.

The inner frame rear panel 60 is attached to a transverse panel 62 of the outer enclosure 24. The transverse panel 62 defines a rear end of the resonator chamber 34, and as shown can be positioned forward of a rearmost outer panel 66 of the outer enclosure 24. The transverse panel 62 can include an opening through which the high frequency drivers 48A and the wave guide 56 can be passed, from front to rear, during assembly. Between the transverse panel 62 and the rearmost outer panel 66, the wave guide 56 and high frequency drivers 48A can be accommodated in a chamber divided from and acoustically sealed from the resonator chamber 34. Attachment between the outer enclosure 24 and the inner frame 28 is made by a plurality of fastener joints, including forward and rearward fastener joints 70A, 70B. At least some of the forward fastener joints 70A are distributed around multiple sides of the inner frame 28 and positioned closer to the front opening 30 of the outer enclosure than a rear end of the inner frame 28, e.g., rear panel 60. The forward fastener joints 70A are positioned within the frontal 30 percent of the inner frame front-rear depth, or within the frontal 20 percent thereof, in some constructions. The forward fastener joints 70A can be provided in an arrangement of two per side (top, bottom, left, and right sides) for a total of eight. The forward fastener joints 70A can be partially or fully recessed in an interior surface of the inner frame 28. Unlike the forward fastener joints 70A, the rearward fastener joints 70B all secure along parallel axes (e.g., front-rear). While the forward fastener joints 70A are accessible for assembly from the interior of the inner frame 28 (e.g., the acoustic horn surface), the rearward fastener joints 70B are accessible for assembly through one or more access ports 80 in the outer enclosure 24, rearward of the resonator chamber 34. The access ports 80 can be closed with removable panels upon final assembly and operation. In contrast, the resonator chamber 34 in which the speaker drivers 48B are positioned may be completely devoid of removable panels and access ports around the side walls of the outer enclosure 24.

In some constructions, the fastener placement is selected to minimize unwanted panel vibration and resonance in either or both of the inner frame 28 and the outer enclosure 24. For example, placing some or all of the fastener joints 70A, 70B at antinodes of the natural panel resonances minimizes the extent to which they can be excited. There are varying degrees of optimization which can be done in this regard, including in some cases FEA simulation-based optimization.

The overall envelope of the speaker assembly 20 can be quite large in some constructions, for example at least 300 liters in volume, and in some cases 400 liters or more in volume. Thus, it follows that the outer enclosure 24 and the inner frame 28 are quite large, and with the numerous fastener joints 70A, 70B, may introduce a significant amount of tolerance stack-up, especially when one or both of the outer enclosure 24 and the inner frame 28 are constructed of wood as opposed to precision-molded plastics. However, because the perimeter port 42 is formed between the outer perimeter portion of the inner frame 28 and the front opening 30 of the outer enclosure 24, assembly tolerances that may affect the placement (even if significantly off-center) of the inner frame 28 in the front opening 30 do not affect the performance of the speaker assembly 20, vis-à-vis the bass-reflex porting provided by the port 42. The performance is a function of the total cross-section area of the port 42 and the volume of the resonator chamber 34, regardless of the shape or layout of the port 42. As a result, any shifting to one side that reduces port area simultaneously results in increasing the port area on the opposite side. The perimeter port 42 also maximizes space efficiency for the given port and inner frame sizing by not requiring an entire offsetting of the inner frame 28 in the front opening 30 to make room for a designated port location (e.g., conventional circular port).

Figure 7:
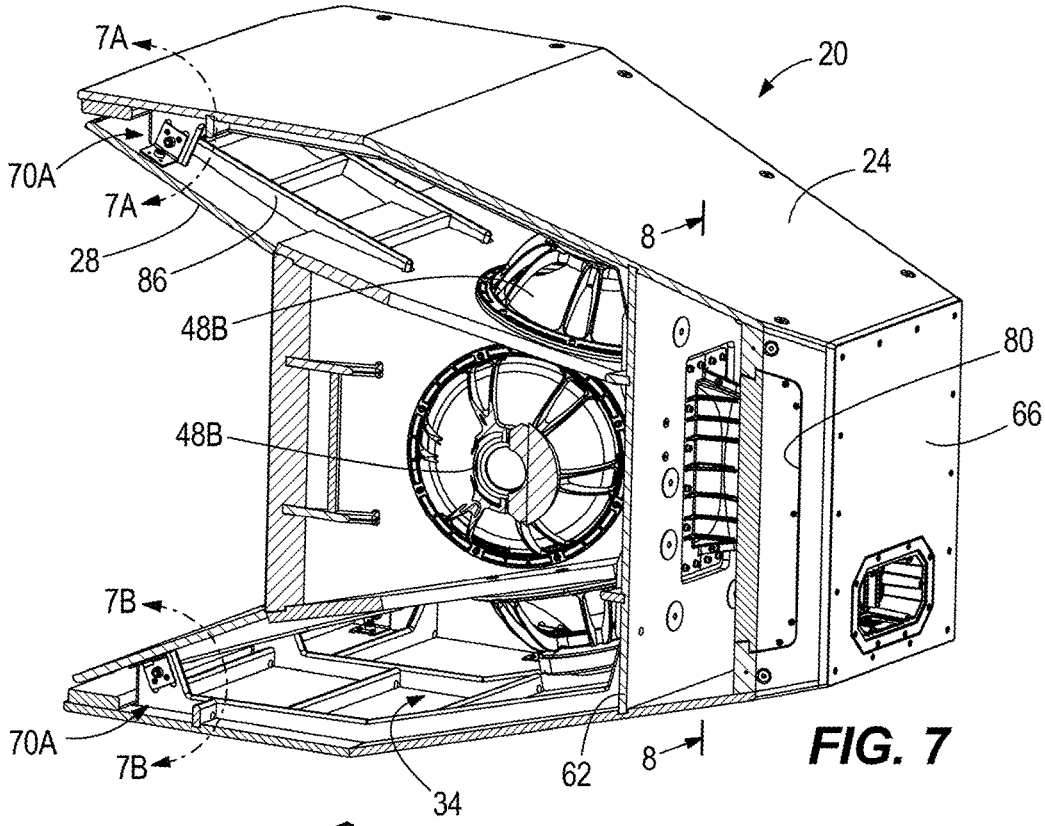
FIG. 7 is a cross-section view, taken along line 7-7 of FIG. 6.
Figure 7A:
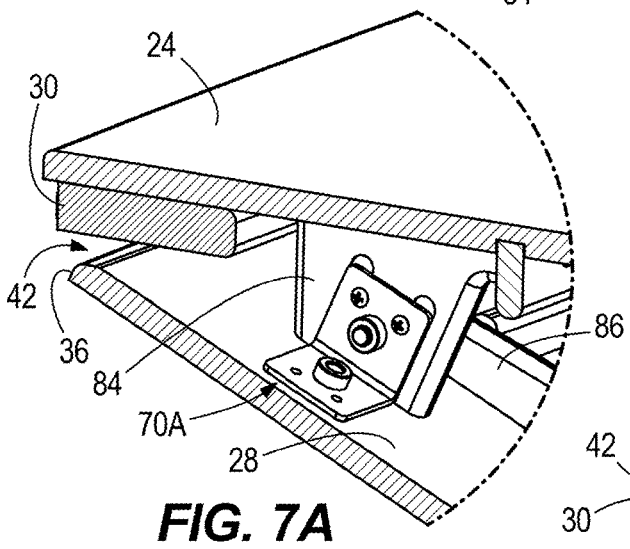
FIG. 7A is a detail view of a portion of FIG. 7 showing an assembled forward fastener joint.
Figure 7B:
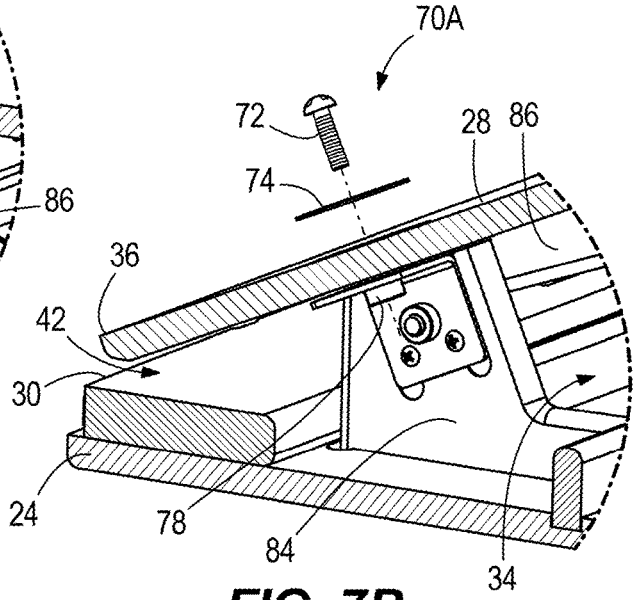
FIG. 7B is a detail view of a portion of FIG. 7 showing an exploded forward fastener joint.
Figure 8:
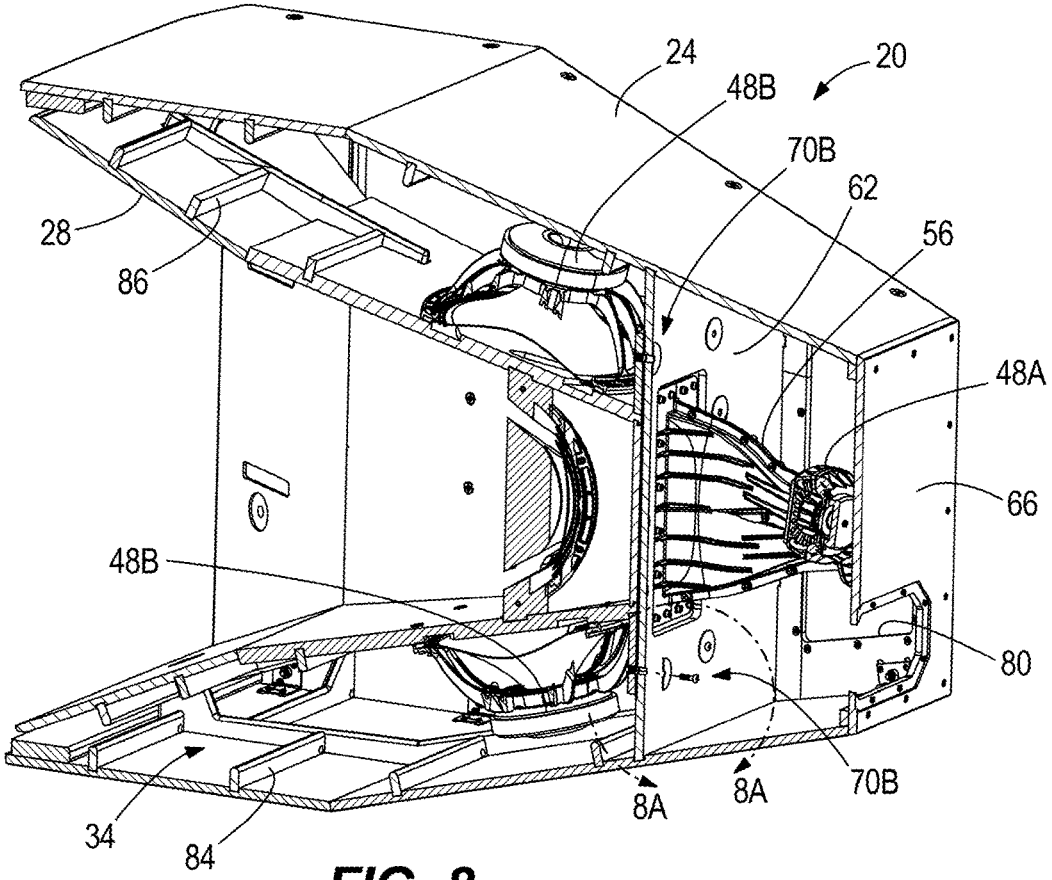
FIG. 8 is a cross-section view, taken along line 8-8 of FIG. 7.
Figure 8A:
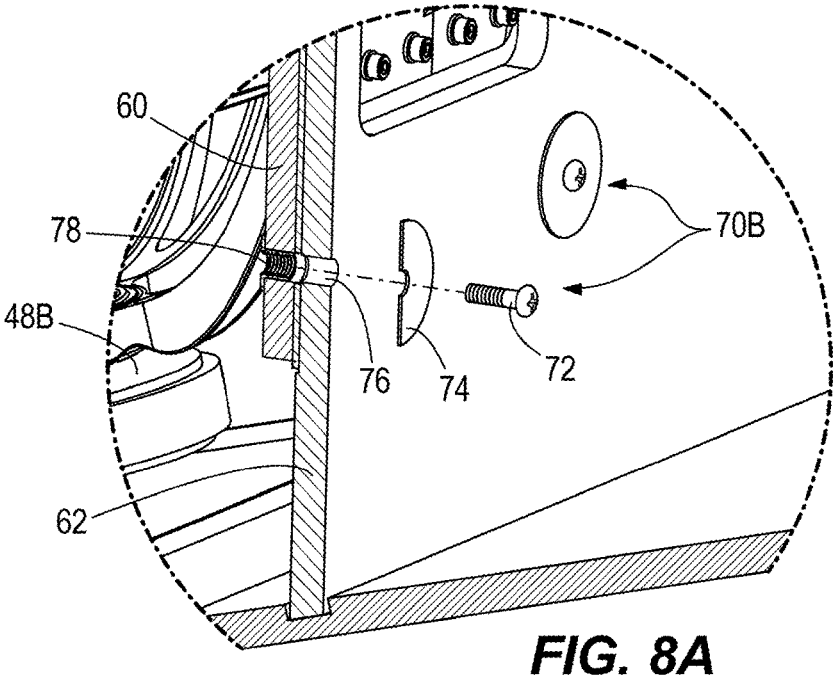
FIG. 8A is a detail view of a portion of FIG. 8 showing a rearward fastener joint.

The fastener joints 70A, 70B are configured to absorb the assembly tolerance between the outer enclosure 24 and the inner frame 28. The tolerances on the overall dimensions of the speaker assembly 20 are determined only by the pieces in the outer enclosure 24. The inner frame 28 has its own tolerances, and the tolerance stack-up is taken up by the fastener joints 70A, 70B that mount the two together. Because the performance of the resonator chamber 34 is not dependent upon a precise placement of the inner frame 28 within the front opening 30, this is advantageously leveraged in order to preclude the need to hold very strict tolerances for assembly of the inner frame 28 to the outer enclosure 24. This is accomplished through the fastener joints 70A, 70B, each of which includes a threaded fastener 72, a washer 74, a clearance hole 76 for receiving the threaded fastener 72, and a nut portion 78 for engaging the threaded fastener 72. The threaded fasteners 72 can be of a relatively large size (e.g., M8, M10 or larger). As best shown in FIGS. 7B and 8A, the nut portions 78 can be formed as part of an angle bracket in the case of the forward fastener joints 70A, and can be formed as T-nuts in the case of the rearward fastener joints 70B. However, the nut portions 78 can be formed in a variety of ways in alternate constructions, for example, spring nuts, speed nuts, self-clinching nuts, locking nuts, or in some cases conventional nuts. The angle brackets at the forward fastener joints 70A can be secured to structural ribbing 84 protruding inward from the inner wall surface of the outer enclosure 24. As shown in FIGS. 7 and 8, similar structural ribbing 86 can be provided to protrude outward from the outer wall surface of the inner frame 28. The respective ribbing 84, 86 can abut, form a sliding interface, overlap in a radial direction, or otherwise interface with each other. As shown, the angle brackets at the forward fastener joints 70A have a portion that lies coplanar with (e.g., and directly against) the outer wall surface of the inner frame 28, and this negates the need for additional brackets or hardware extending from the inner frame 28. In other constructions, a single bracket between the inner frame 28 and the outer enclosure 24 can have a portion that lies coplanar with (e.g., and directly against) the inner wall surface of the outer enclosure 24. In either case, a single bracket is used at each forward fastener joint 70A, despite that the outer wall surface of the inner frame 28 and the inner wall surface of the outer enclosure 24 are non-parallel, i.e., arranged at a skew or oblique angle.

Even for the large-sized threaded fasteners 72, the washers 74 can be oversized (e.g., outer diameter of 5 times or more the shank diameter of the threaded fastener 72). The reason for oversizing the washers 74 is to ensure that the washers 74 sufficiently extend beyond the clearance holes 76 when assembled. Given that these fastener joints 70A, 70B are designed as the part of the speaker assembly 20 that accommodates assembly tolerance between the primary nested components of the outer enclosure 24 and the inner frame 28, the clearance hole 76 of each of the plurality of fastener joints 70A, 70B provides a clearance at least 25 percent over (e.g., 35 percent over) the standard "normal" clearance for the size of the threaded fastener 72. The standard normal fastener clearance diameter is determined by an American or international engineering organization or governing body, e.g., ASME B18.2.8. Although all of the fastener joints 70A, 70B can be provided with identical fasteners 72 and clearance dimensioning throughout the sum total of interfaces between the outer enclosure 24 and the inner frame 28, it is also contemplated that intentional variation may be utilized at different ones of the fastener joints 70A, 70B.

The method of assembly of the speaker assembly 20 is significantly easier than most speaker assemblies of similar size and makeup. According to aspects of the present disclosure, the low frequency speaker drivers 48B are mounted to the inner frame 28 prior to insertion of the inner frame into the outer enclosure 24. Thus, a subassembly of one or more speaker drivers is created outside of and separate from the outer enclosure 24. This removes the requirement for access panels to install the low frequency speaker drivers 48B, and as such, the outer enclosure 24 may be provided with none. In some constructions, the high frequency driver(s) 48A and/or supporting electronics (e.g., frequency-filtering crossover network) are assembled to the inner frame 28 prior to installation into the outer enclosure 24. To this extent of this concept, a complete subassembly unit (FIGS. 3 and 4) may be formed to include the inner frame 28, multiple speaker drivers, including multiple high frequency drivers 48A (e.g., and associated wave guide 56) and multiple low frequency drivers 48B, and corresponding crossover networks prior to assembly into the outer enclosure 24. Assembly is completed by rearward insertion of the subassembly unit with the inner frame 28 through the front opening 30 of the outer enclosure 24 to a depth at which the fastener joints 70A, 70B can be secured. As mentioned above, precision at this step is not required as the fastener joints 70A, 70B absorb the assembly tolerance and uniformity around the perimeter port 42 is not a prerequisite to achieve the prescribed performance. However, if it is desired to precisely place the inner frame 28 with respect to the outer enclosure 24 (e.g., centered in the front opening 30), this may be achieved by the use of temporary or permanent spacers between the outer enclosure 24 and the inner frame 28 to set the desired spacing prior to final securement of the fastener joints 70A, 70B.

Various aspects of the present disclosure are set forth in the following claims.

What is claimed is:

1. A ported speaker assembly comprising:

an outer enclosure having a front opening;

an inner frame positioned at least partially within the outer enclosure and having an outer perimeter portion proximate the front opening of the outer enclosure;

a resonator chamber defined between an interior of the outer enclosure and an exterior of the inner frame;

at least one speaker driver mounted to the inner frame and configured to emit sound from a front end of the ported speaker assembly;

a perimeter port formed between the outer perimeter portion of the inner frame and the front opening of the outer enclosure to establish sound wave communication between the resonator chamber and a surrounding external atmosphere for tuned-frequency resonance output, and wherein the perimeter port extends uninterrupted about the outer perimeter edge of the inner frame so as to encircle the outer perimeter edge; and a plurality of fastener joints securing the inner frame to the outer enclosure, wherein at least some of the plurality of fastener joints are distributed around multiple sides of the inner frame and positioned closer to the front opening of the outer enclosure than a rear end of the inner frame, wherein the plurality of fastener joints are configured to absorb all assembly tolerance between the outer enclosure and the inner frame such that the tolerances on the overall dimensions of the speaker assembly are determined by the outer enclosure alone.

2. The ported speaker assembly of claim 1, wherein the outer perimeter portion of the inner frame is provided by a forwardmost edge of the inner frame.

3. The ported speaker assembly of claim 1, wherein the inner frame is an acoustic horn for the at least one speaker driver mounted thereto.

4. The ported speaker assembly of claim 1, wherein a total envelope of the ported speaker assembly is at least 300 liters in volume.

5. The ported speaker assembly of claim 1, wherein the at least one speaker driver includes multiple low frequency speaker drivers and multiple high frequency speaker drivers.

6. The ported speaker assembly of claim 1, wherein each of the plurality of fastener joints includes a threaded fastener that extends through a corresponding clearance hole, and wherein the clearance hole of each of the plurality of fastener joints provides a clearance at least 25 percent over standard normal clearance for the size of the threaded fastener.

7. The ported speaker assembly of claim 1, wherein the at least one speaker driver includes at least one low frequency speaker driver positioned within the resonator chamber, and wherein the outer enclosure is devoid of access ports into the resonator chamber.

8. A ported speaker assembly comprising:

an outer enclosure having a front opening defined between a top side, a bottom side, and two lateral sides;

an inner frame positioned at least partially within the outer enclosure and having an outer perimeter portion proximate the front opening of the outer enclosure;

a resonator chamber defined between an interior of the outer enclosure and an exterior of the inner frame;

at least one speaker driver mounted to the inner frame and configured to emit sound from a front end of the ported speaker assembly;

a perimeter port formed between the outer perimeter portion of the inner frame and the front opening of the outer enclosure to establish sound wave communication between the resonator chamber and a surrounding external atmosphere for tuned-frequency resonance output; and a plurality of fastener joints securing the inner frame to the outer enclosure, each of the plurality of fastener joints including a threaded fastener, a clearance hole for receiving the threaded fastener, and a nut portion for engaging the threaded fastener, wherein the clearance hole of each of the plurality of fastener joints provides a clearance at least 25 percent over standard normal clearance for the size of the threaded fastener.

9. The ported speaker assembly of claim 8, wherein the plurality of fastener joints are dispersed among the top, bottom, and two lateral sides on an interior of the outer enclosure, wherein the plurality of fastener joints are provided on a front half of an overall depth of the speaker assembly.

10. The ported speaker assembly of claim 8, wherein the clearance hole of each of the plurality of fastener joints provides a clearance at least 35 percent over standard clearance for the size of the threaded fastener.

11. The ported speaker assembly of claim 8, wherein the total envelope of the ported speaker assembly is at least 300 liters in volume.

12. The ported speaker assembly of claim 8, wherein the inner frame is an acoustic horn for the at least one speaker driver mounted thereto.

13. The ported speaker assembly of claim 8, wherein the outer perimeter portion of the inner frame is provided by a forwardmost edge of the inner frame.

14. The ported speaker assembly of claim 8, wherein the at least one speaker driver includes multiple low frequency speaker drivers and multiple high frequency speaker drivers.

15. A method of assembling a ported speaker assembly, the method comprising:

providing an outer enclosure having a front opening;

providing an inner frame having an outer perimeter portion with a shape that corresponds to that of the front opening and a size that is smaller than that of the front opening;

assembling at least one speaker driver to the inner frame with the inner frame removed from the outer enclosure;

inserting the inner frame with the at least one mounted speaker driver into the outer enclosure through the front opening thereof to form a perimeter port between the outer perimeter portion of the inner frame and the front opening of the outer enclosure, wherein a resonator chamber is defined between an interior of the outer enclosure and an exterior of the inner frame; and absorbing all assembly tolerance between the inner frame and the outer enclosure through a plurality of fastener joints that are secured between the inner frame and the outer enclosure.

16. The method of claim 15, wherein the insertion of the inner frame includes passing at least one high frequency speaker driver through the resonator chamber and into a separate acoustically-sealed chamber of the outer enclosure while simultaneously positioning at least one low frequency speaker driver inside the resonator chamber.

17. The method of claim 15, wherein securing each of the plurality of fastener joints includes inserting a threaded fastener through a clearance hole and engaging the threaded fastener with a nut portion, wherein the clearance hole of each of the plurality of fastener joints provides a clearance at least 25 percent over standard normal clearance for the size of the threaded fastener.

18. The method of claim 15, wherein securing the plurality of fastener joints includes securing a plurality of forward fastener joints dispersed among top, bottom, and two lateral sides on an interior of the outer enclosure, at a position within a front half of an overall depth of the speaker assembly, and securing a plurality of rearward fastener joints at an interface of a rear panel of the inner frame and a transverse panel of the outer enclosure that defines a rear end of the resonator chamber.

19. The method of claim 18, wherein the plurality of forward fastener joints are secured from an open front end of the inner frame, and the plurality of rearward fastener joints are secured through an access port in the outer enclosure.

* * * * *